US006570314B2

(12) United States Patent
Daimon et al.

(10) Patent No.: US 6,570,314 B2
(45) Date of Patent: May 27, 2003

(54) COLOR DISPLAY TUBE

(75) Inventors: Toshihiro Daimon, Osaka (JP); Yasufumi Wada, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 95 days.

(21) Appl. No.: 09/812,516

(22) Filed: Mar. 20, 2001

(65) Prior Publication Data

US 2001/0030500 A1 Oct. 18, 2001

(30) Foreign Application Priority Data

Apr. 14, 2000 (JP) ..... 2000-113765

(51) Int. Cl.[7] ..... H01J 29/50

(52) U.S. Cl. ..... 313/414; 313/441; 313/412; 313/416; 313/449

(58) Field of Search ..... 313/414, 458, 313/441, 444, 448, 412, 416, 449

(56) References Cited

U.S. PATENT DOCUMENTS 4,086,513 A * 4/1978 Evans ..... 313/414
4,581,560 A 4/1986 Shirai et al. ..... 313/414
5,023,508 A * 6/1991 Park ..... 313/414
5,581,147 A * 12/1996 Koh et al. ..... 313/414

FOREIGN PATENT DOCUMENTS

JP 2-18540 4/1990
JP 10-275570 10/1998

* cited by examiner

*Primary Examiner*—Ashok Patel
*Assistant Examiner*—Jason Phinney
(74) *Attorney, Agent, or Firm*—Merchant & Gould, P.C.

(57) ABSTRACT

A vertical electrode plate having three openings formed in-line through which three electron beams pass respectively is provided only inside a focusing electrode out of the focusing electrode and a final accelerating electrode. A horizontal electrode plate that is substantially parallel to an in-line plane extending toward the focusing electrode is formed at least one of above and below openings at the bottom of a shielding cup, only inside the final accelerating electrode. By setting the height h of the horizontal electrode plate optimally, it is possible to correct a horizontally-elongated distortion of a spot shape in edge portions of a screen, caused by a self-convergence magnetic field of a deflecting device. In this manner, a color display tube that achieves an image display with a high resolution can be provided.

5 Claims, 7 Drawing Sheets

COLOR DISPLAY TUBE

BACKGROUND OF THE INVENTION

1. Field of the Invention

The present invention relates to a color display tube. It relates in particular to a color display tube characterized by electrodes that constitute a main lens for focusing three electron beams on a phosphor screen.

2. Description of Related Art

A color display tube device generally has an envelope including a panel and a funnel that is connected integrally therewith. An electron gun is disposed in a neck portion of the funnel. A deflecting device is mounted outside the funnel. A phosphor screen is formed on an inner surface of the panel so as to face a shadow mask. Three electron beams emitted from the electron gun are deflected by horizontal and vertical deflection magnetic fields generated by the deflecting device and excite the phosphor screen while scanning it horizontally and vertically, thereby displaying a color image.

The magnetic fields generated by the deflecting device used in such a color display tube device generally has a self-convergence structure, in which the three electron beams are converged on a screen. For this purpose, the horizontal deflection magnetic field and the vertical deflection magnetic field are distorted to have a pincushion shape and a barrel shape respectively. Accordingly, the three electron beams passing through the deflection magnetic fields are subjected to a diverging effect in a horizontal direction and to a focusing effect in a vertical direction respectively. In the present application, such focusing effect on the electron beams that is larger in the vertical direction than in the horizontal direction due to the diverging effect in the horizontal direction and the focusing effect in the vertical direction is referred to as a negative astigmatism.

When the electron beams come to travel further along with an increase in a deflection angle, because of the self-convergence magnetic field described above, the diverging effect in the horizontal direction and the focusing effect in the vertical direction become distinctive, especially at edge portions of the phosphor screen. Consequently, electron beam spots on the phosphor screen become elongated horizontally such that the major axis is parallel to the horizontal direction, causing a problem of lowering a horizontal resolution. The recent development of flatter panels and larger deflection angle makes the above problem more and more serious.

In general, when the deflecting device has the self-convergence structure, the above-described deformation of the spot shape occurs easily. Thus, in order to display images with high resolution on the phosphor screen, the electron gun has to achieve a smaller spot diameter in the horizontal direction.

Although various factors generally influence the spot diameter in the color display tube device, the spherical aberration of a main lens contributes most to the spot diameter in its relationship with the main lens of the electron gun. In other words, the spot diameter can be reduced with a decrease in the spherical aberration of the main lens of the electron gun. When an incident angle of the electron beam into the main lens is indicated by $\alpha$, the spot diameter $\delta$ is expressed by $$\delta=(M\cdot Csp\cdot\alpha^3)/2$$

where M is a lens magnification and Csp is a spherical aberration coefficient. When the focusing effect of the main lens is weakened, the lens magnification and the spherical aberration are reduced. One of the methods for weakening the focusing effect of the main lens is to increase an equivalent diameter of the main lens. In other words, by increasing an effective main lens diameter, it is possible to achieve a smaller spot diameter on the phosphor screen.

JP 2(1990)-18540 B discloses a conventional main lens in an electron gun for a color display tube. As shown in FIG. 11, the main lens is constituted by a focusing electrode 32, a final accelerating electrode 33 and a shielding cup 34 connected to the final accelerating electrode 33. The focusing electrode 32 and the final accelerating electrode 33 are spaced away from each other in a tube axis direction. The focusing electrode 32 and the final accelerating electrode 33 respectively include peripheral electrodes 35 and 36 surrounding three electron beams 8*a*, 8*b* and 8*c* and electrode plates (hereinafter, referred to as "vertical electrode plates") 37 and 38. The vertical electrode plates 37 and 38 are retracted with respect to the opposing end faces of the peripheral electrodes 35 and 36 and arranged so as to allow the electron beams to pass substantially perpendicular thereto.

FIG. 12 shows a front view of the vertical electrode plates 37 and 38. Openings 39*a*, 39*b*, 39*c* in the vertical electrode plate 37 and openings 40*a*, 40*b* and 40*c* in the vertical electrode plate 38 are formed to have a horizontal diameter smaller than their vertical diameter.

The vertical electrode plates 37 and 38, which are arranged inside the respective peripheral electrodes 35 and 36 of the focusing electrode 32 and the final accelerating electrode 33 constituting the main lens, are retracted as described above, thereby allowing a high electric potential of the final accelerating electrode 33 to enter deeply into the focusing electrode 32 and a low electric potential of the focusing electrode 32 to enter deeply into the final accelerating electrode 33. This increases the effective main lens diameter, thereby achieving a smaller spot diameter on the phosphor screen.

Also, the negative astigmatism, in which the lens focusing effect is stronger in the vertical direction than in the horizontal direction owing to the peripheral electrodes 35 and 36 having their diameter larger in the horizontal direction, is eliminated by making an opening diameter in the horizontal direction Rh smaller than that in the vertical direction Rv in the vertical electrode plates 37 and 38 so as to prevent the entrance of the electric potential in the horizontal direction.

However, such an electron gun in the conventional color display tube device has had a limitation in increasing the main lens diameter and adjusting the astigmatism concurrently. In this technique, the vertical electrode plates are retracted in order to increase the main lens diameter. On the other hand, however, the horizontal diameter of the openings of the vertical electrode plates is reduced in order to adjust the astigmatism, resulting in a limitation in increasing the main lens diameter especially in the horizontal direction.

SUMMARY OF THE INVENTION

The object of the present invention is to provide a color display tube having a main lens portion structure that can adjust astigmatism easily and achieve a higher horizontal resolution by increasing a main lens diameter in a horizontal direction with a relatively simple configuration.

In order to achieve the object mentioned above, a color display tube of the present invention includes an envelope including a front panel on which a phosphor screen is formed and a funnel, and an in-line electron gun that is provided in a neck portion of the funnel and emits three electron beams. The in-line electron gun has a focusing electrode and a final accelerating electrode that are disposed facing each other in a tube axis direction so as to have a predetermined space therebetween and constitute a main lens, and a shielding cup that has a bottom provided with at least one opening through which the electron beams pass and is connected to a side of the phosphor screen of the final accelerating electrode via the bottom of the cup. A vertical electrode plate having three openings formed in-line through which the three electron beams pass respectively is provided only inside the focusing electrode out of the focusing electrode and the final accelerating electrode. A horizontal electrode plate that is substantially parallel to an in-line plane is formed so as to extend toward the focusing electrode at least one of above and below the opening provided at the bottom of the shielding cup. The horizontal electrode plate is only inside the final accelerating electrode out of the focusing electrode and the final accelerating electrode.

This configuration makes it possible both to increase the main lens diameter in the horizontal direction as desired and to adjust the astigmatism. Thus, even when the horizontally-elongated distortion of the spots becomes distinct at edge portions of the phosphor screen owing to the development of flatter panels and larger deflection angle, the horizontal spot diameter is reduced by the electron gun, thereby alleviating the horizontally-elongated distortion. In this manner, it becomes possible to provide the color display tube device with a high resolution.

It is preferable that the number of the openings formed at the bottom of the shielding cup is three, and the three openings all have a circular shape.

With this configuration, an assembly jig used in assembling the electron gun can have a circular shape, eliminating the need for a complex shape. Thus, it becomes easier to process the assembly jig, and further to assemble the electron gun.

Also, it is preferable that at least one of the openings provided at the bottom of the shielding cup has a non-circular shape.

With this configuration, an astigmatism amount provided to the three electron beams can be adjusted individually. Also, it is possible to restrict a variation of the astigmatism amount by a punching accuracy of the openings alone.

Furthermore, it is preferable that a central opening of the three openings provided in the vertical electrode plate has a diameter in an in-line direction smaller than that in a direction perpendicular to the in-line direction.

With this configuration, it is possible to eliminate the negative astigmatism, in which a lens focusing effect on the electron beam passing through the central opening is larger in the vertical direction than in the horizontal direction owing to a peripheral electrode having its diameter larger in the horizontal direction.

In addition, it is preferable that a height of the horizontal electrode plate in the vicinity of a central beam of the three electron beams is different from that in the vicinity of beams on both sides.

With this configuration, not only can the main lens diameter in the horizontal direction be increased, but also the astigmatism amount provided in the three electron beams can be adjusted individually.

DESCRIPTION OF THE PREFERRED EMBODIMENTS

The following is a description of an embodiment of the present invention, with reference to the accompanying drawings.

Figure 2:
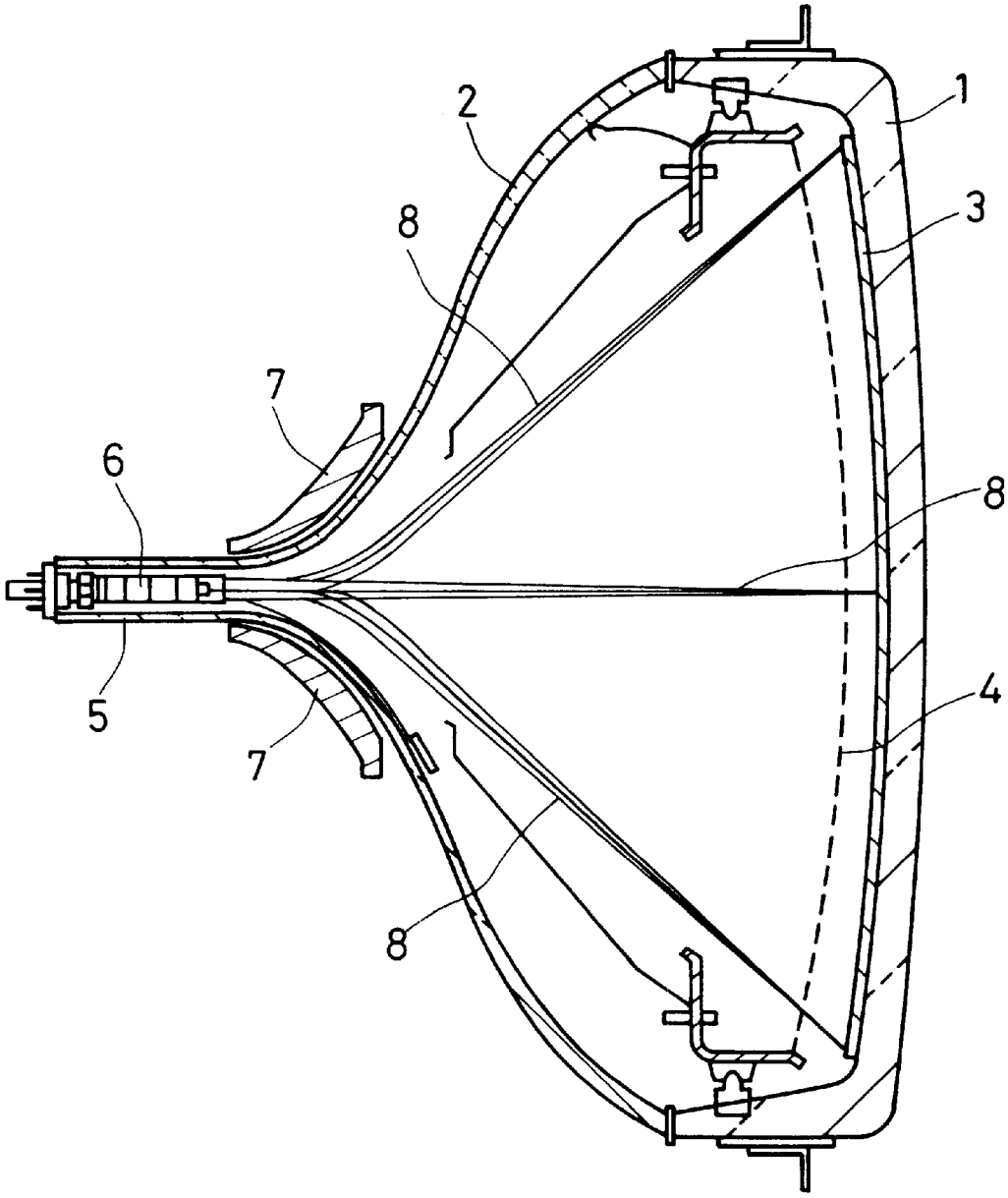
FIG. 2 is a sectional view in the horizontal direction showing the color display tube of the present invention.

A color display tube shown in FIG. 2 has an envelope including a panel 1 and a bell-shaped funnel 2 connected integrally with this panel 1. On an inner surface of the panel 1, a phosphor screen 3 that is formed of phosphor layers with three colors giving off blue, green and red lights is formed. A shadow mask 4 in which many electron beam passing holes are formed is arranged so as to face this phosphor screen 3. An electron gun 6 is arranged in a neck portion 5 of the funnel 2. Inside the electron gun 6 are three cathodes emitting three electron beams 8 arranged in-line in a horizontal direction. A color display tube device has a deflection yoke 7 mounted on the color display tube described above. The deflection yoke 7 is mounted on the border of a portion having a larger diameter and the neck portion 5 of the funnel 2 and deflects the electron beams 8 emitted from the electron gun 6 in horizontal and vertical directions.

Figure 1:
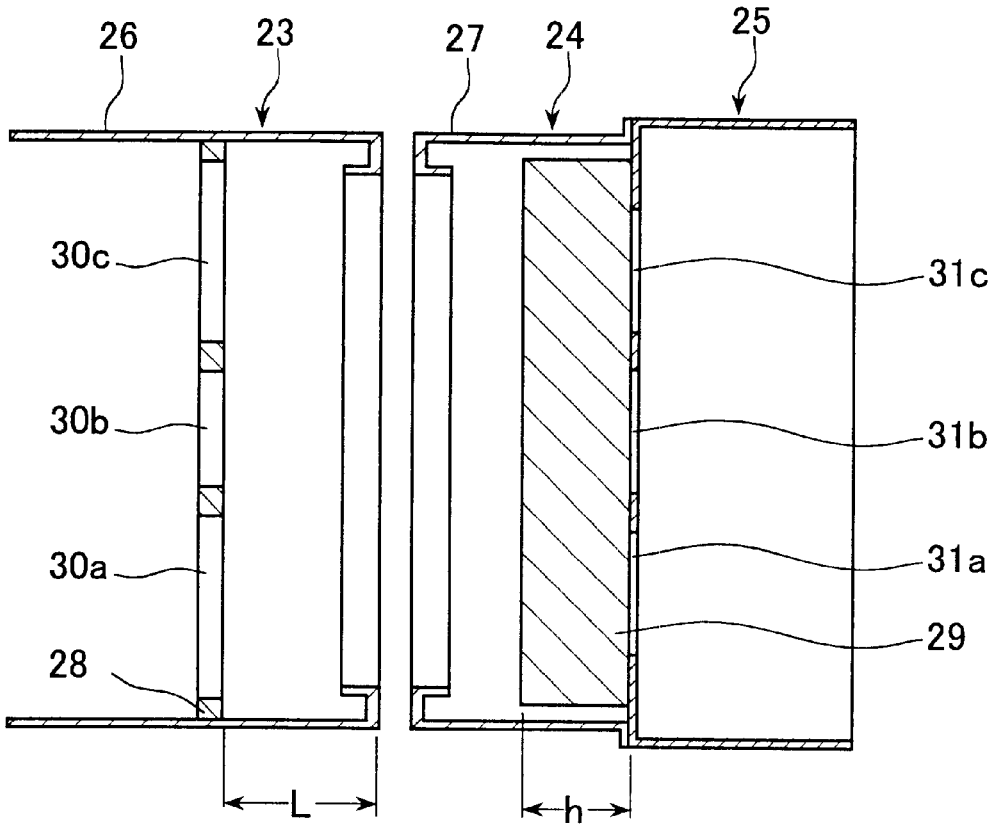
FIG. 1 is a sectional view in a horizontal direction mainly showing a main lens of an electron gun used in a color display tube of the present invention.

As shown in FIG. 1, a main lens of the electron gun according to the present invention is constituted by a focusing electrode 23, a final accelerating electrode 24 and a cup-shaped shielding cup 25 connected to the final accelerating electrode 24. The focusing electrode 23 and the final accelerating electrode 24 are spaced away from each other in a tube axis direction. In FIG. 1, the right side of the sheet corresponds to a phosphor screen side.

Figure 3:
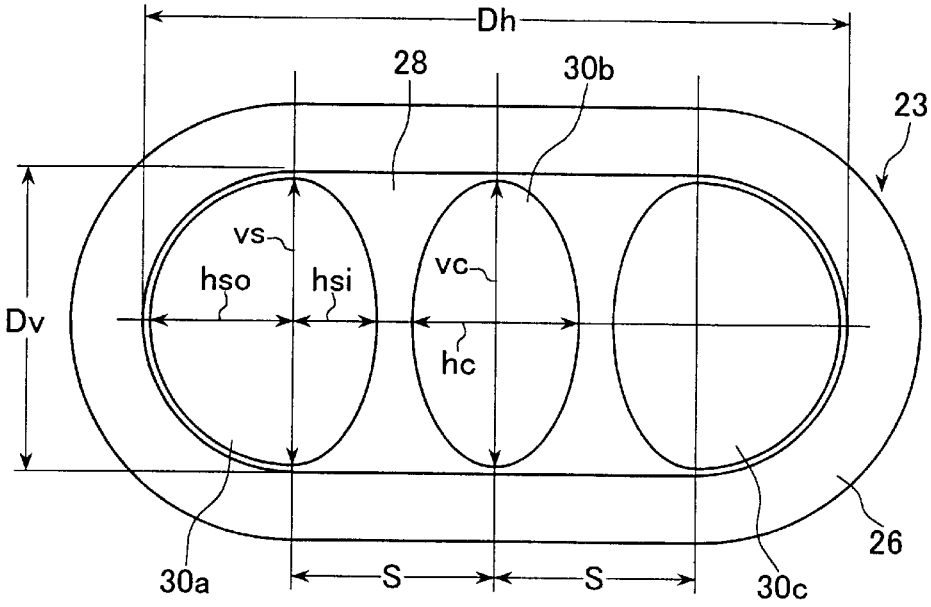
FIG. 3 is a front view showing a focusing electrode constituting the electron gun shown in FIG. 1.

As shown in FIGS. 1 and 3, the focusing electrode 23 constituting the main lens has a peripheral electrode 26 surrounding the three electron beams (not shown in these figures) and a vertical electrode plate 28. When seen in a direction parallel to the tube axis, the peripheral electrode 26 has an elliptical shape with its major axis parallel to the horizontal direction. In the vertical electrode plate 28, three openings 30*a*, 30*b* and 30*c*, through which the three electron beams pass, are formed so as to be aligned horizontally.

The final accelerating electrode 24 is constituted only by a peripheral electrode 27 surrounding the three electron beams. When seen in a direction parallel to the tube axis, the peripheral electrode 27 has an elliptical shape with its major axis parallel to the horizontal direction.

Figure 4:
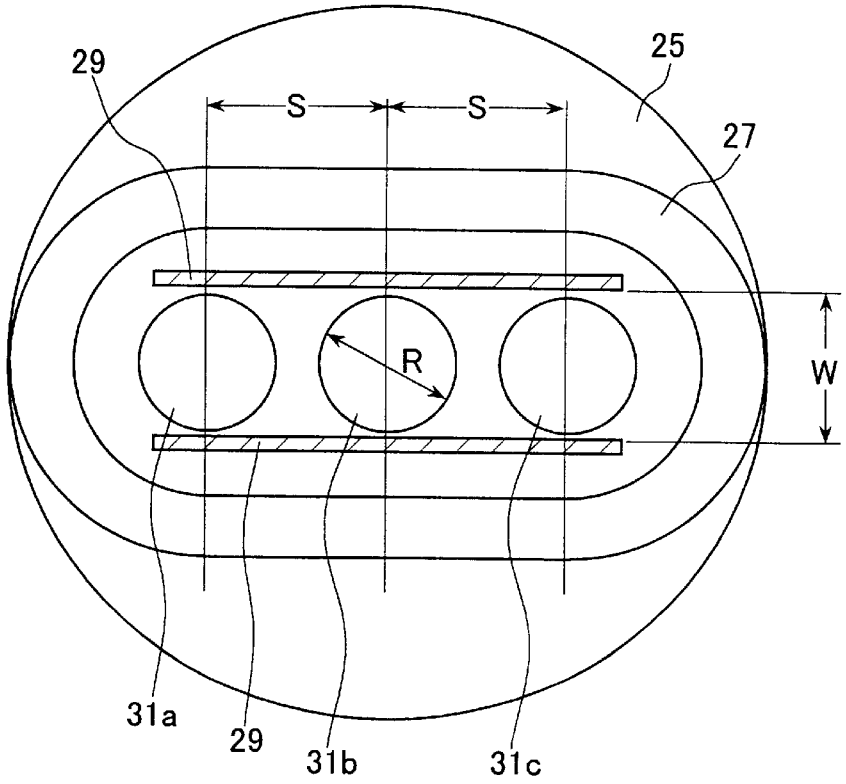
FIG. 4 is a front view showing a final accelerating electrode constituting the electron gun shown in FIG. 1.

As shown in FIG. 1, a bottom of the shielding cup 25 is connected to an end face of the peripheral electrode 27 on the screen side. As shown in FIG. 4, the bottom of the shielding cup 25 is provided with three openings 31*a*, 31*b* and 31*c* having an inner diameter R aligned horizontally, through which the three electron beams (not shown in the figure) pass. Furthermore, the bottom of the shielding cup 25 is provided with a pair of electrode plates (hereinafter, referred to as "horizontal electrode plates") 29 extending toward the focusing electrode 23. The horizontal electrode plates 29 are disposed like screens above and below the openings 31*a*, 31*b* and 31*c* so as to be parallel to a horizontal plane and spaced away from each other.

A low electric potential is applied to the focusing electrode 23, while a high electric potential is applied to the final accelerating electrode 24. A focusing lens and a diverging lens are formed on the focusing electrode 23 side and on the final accelerating electrode 24 side respectively, so that a composite electric field thereof forms a main lens electric field.

The high electric potential of the final accelerating electrode 24 enters deeply into the focusing electrode 23, while the low electric potential of the focusing electrode 23 enters deeply into the final accelerating electrode 24. This increases an effective diameter of the main lens, thereby achieving a smaller spot diameter on the phosphor screen.

Also, the horizontal electrode plates 29 disposed above and below the openings 31*a*, 31*b* and 31*c* of the shielding cup 25 are connected electrically to the final accelerating electrode 24, so as to be supplied with the high electric potential. Therefore, the low electric potential entering inside the final accelerating electrode 24 is suppressed only in the vertical direction, so that the effect of the diverging lens is enhanced in the vertical direction alone. Consequently, it is possible to eliminate a focusing effect of the main lens that is larger in the vertical direction than in the horizontal direction, which is generated by the peripheral electrodes 26 and 27 having their major axes parallel to the horizontal direction, namely, astigmatism (negative astigmatism).

Also, unlike the conventional main lens, since no vertical electrode plate that prevents the entrance of the low electric potential is present inside the final accelerating electrode, it becomes possible to allow the low electric potential of the focusing electrode 23 to enter deeply into the final accelerating electrode 24 especially in the horizontal direction, thereby increasing the main lens diameter in the horizontal direction.

The elimination of the negative astigmatism, in which the lens focusing effect is larger in the vertical direction than in the horizontal direction, was described above. In addition to this, the present invention also can adjust the astigmatism so as to provide an effective astigmatism with the main lens, and further can increase the main lens diameter in the horizontal direction.

Figure 5:
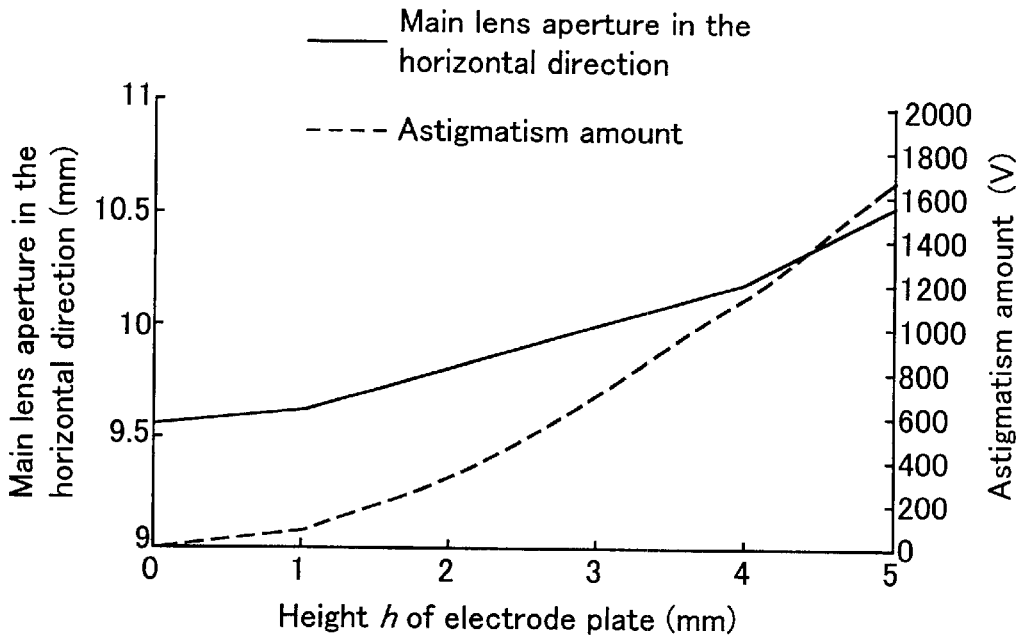
FIG. 5 is a graph showing the relationships of a main lens diameter in the horizontal direction and an astigmatism amount with respect to the height h of a horizontal electrode plate.
Figure 6:
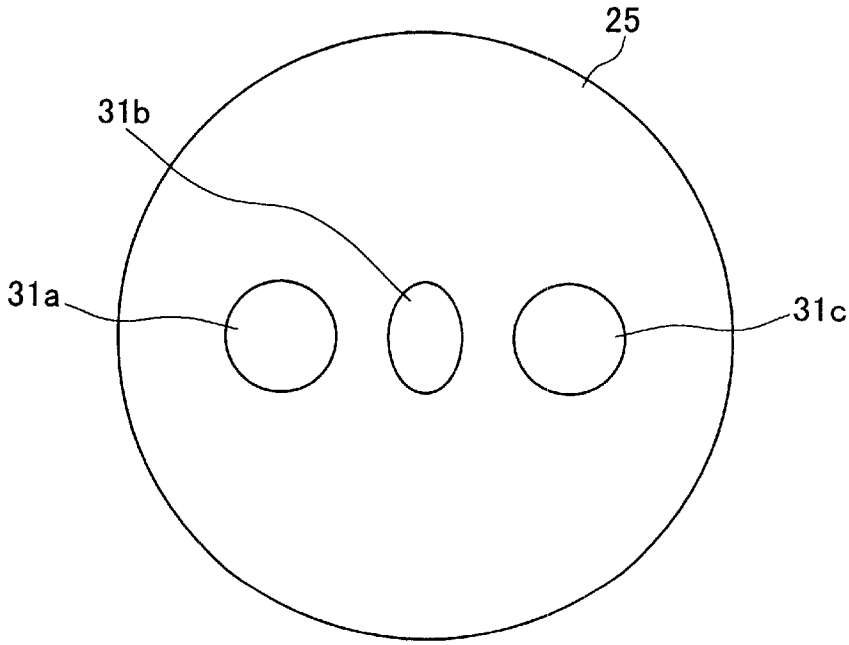
FIG. 6 illustrates the shape of openings on a bottom surface of a shielding cup of the present invention.
Figure 7:
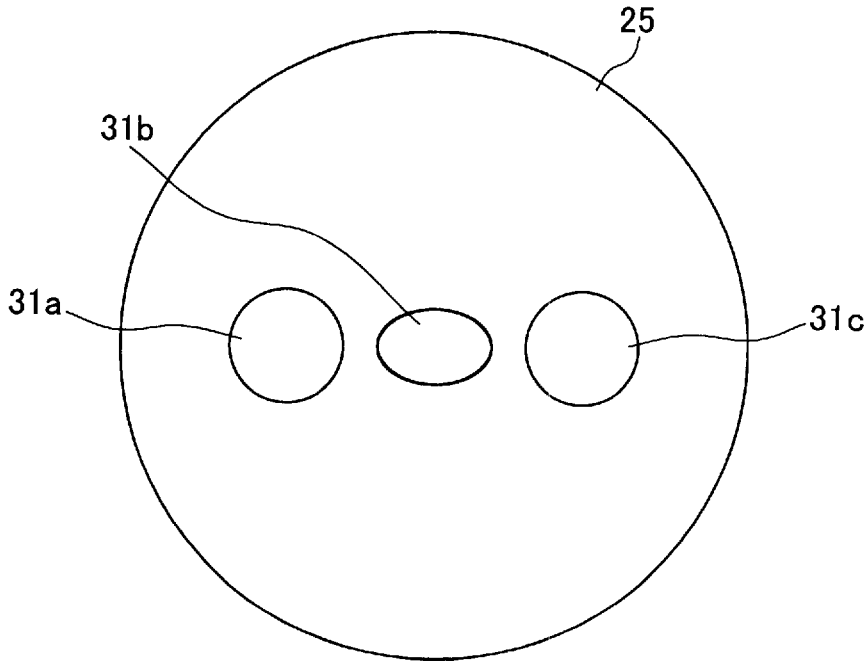
FIG. 7 illustrates the shape of the openings on the bottom surface of the shielding cup of the present invention.
Figure 8:
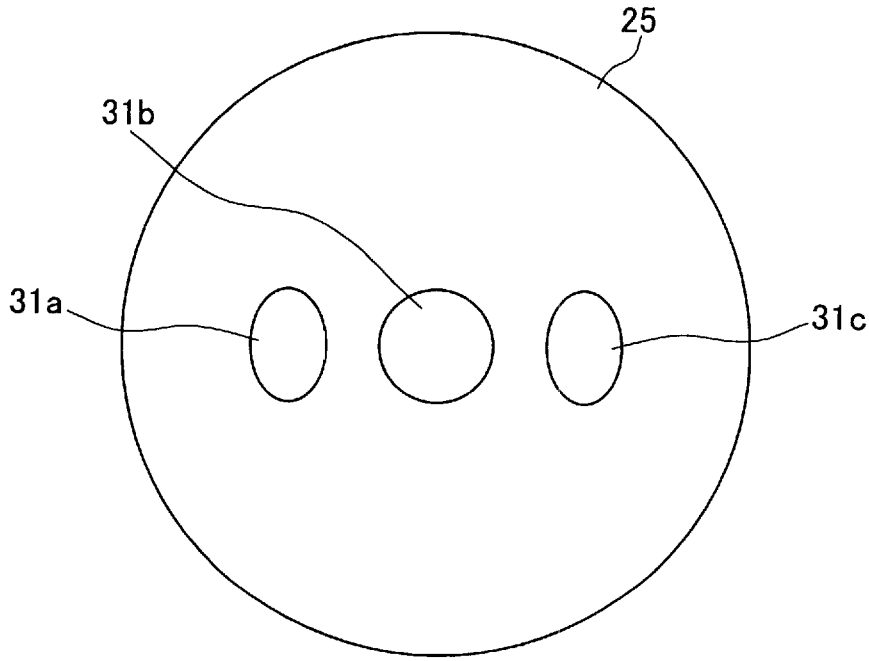
FIG. 8 illustrates the shape of the openings on the bottom surface of the shielding cup of the present invention.
Figure 9:
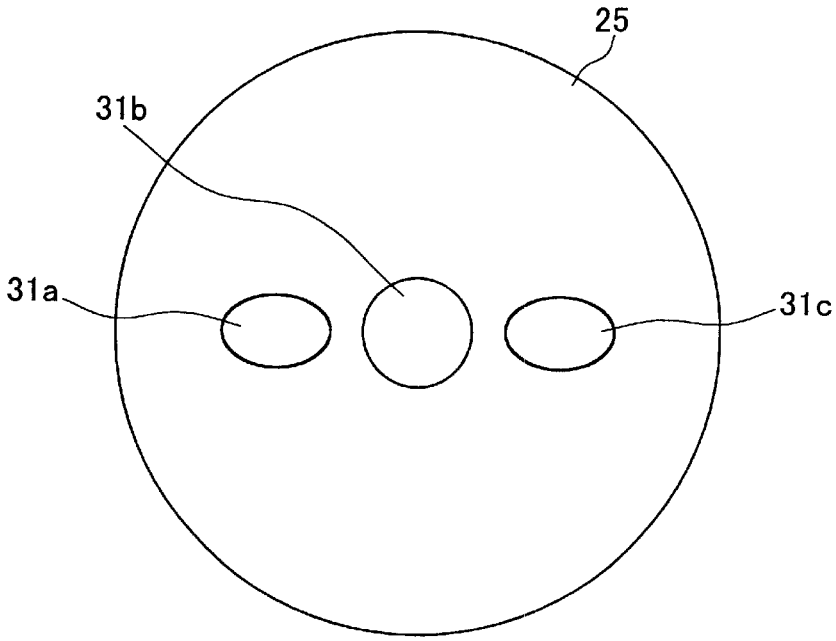
FIG. 9 illustrates the shape of the openings on the bottom surface of the shielding cup of the present invention.

FIG. 5 shows the relationships of the main lens diameter in the horizontal direction and the amount of astigmatism in which the focusing effect is larger in the horizontal direction than in the vertical direction (referred to as a positive astigmatism) with respect to the height h (the height in the tube axis direction; see FIG. 1) of the horizontal electrode plate 29, calculated by a three dimensional simulation. It is shown that, as the height h is extended, the main lens diameter in the horizontal direction further can be increased. It also is shown that the lens focusing effect, which is larger in the horizontal direction than in the vertical direction increases concurrently.

As described earlier, because of the self-convergence magnetic field, the electron beam spots tend to be elongated horizontally to have their major axes parallel to the horizontal direction especially in edge portions of the phosphor screen. The present invention not only eliminates the negative astigmatism, but also provides the main lens with the positive astigmatism. In this manner, the spot diameter in the horizontal direction is reduced at the edge portions of the screen.

In other words, the present invention adjusts the height h of the horizontal electrode plate 29, thereby increasing the positive astigmatism to be provided in the main lens and further increasing the main lens diameter in the horizontal direction, achieving a still higher resolution in the phosphor screen.

Furthermore, in the present invention, since no vertical electrode plate is present inside the final accelerating electrode unlike the conventional electron gun, the height h of the horizontal electrode plate 29 is not restricted by the position of the vertical electrode plate. Therefore, the present invention is very suitable for providing the main lens with the lens focusing effect larger in the horizontal direction rather than in the vertical direction. By changing the height h of the horizontal electrode plate 29 freely, it is possible to reduce the spot diameter in the horizontal direction and improve the resolution easily.

The following is a specific example. As shown in FIG. 3, the focusing electrode 23 has a horizontal opening diameter Dh=1.92 mm and a vertical opening diameter Dv=8.2 mm. In the vertical electrode plate 28, the central opening 30*b* has a vertical diameter of Vc=8.0 mm, the openings 30*a* and 30*c* on both sides have a vertical diameter of Vs=8.0 mm, the central opening 30*b* has a horizontal diameter hc=4.7 mm, and the openings 30*a* and 30*c* on both sides have a horizontal dimension hsi=2.35 mm and hso=4.0 mm. The vertical electrode plate 28 is retracted by an amount of L (see FIG. 1)=5.0 mm. As shown in FIG. 4, the three openings 31*a*, 31*b* and 31*c* of the shielding cup 25 have a diameter R=4.8 mm, the horizontal electrode plates 29 provided to the shielding cup 25 are spaced away from each other by a distance W=6.5 mm, and the distance between centers of the adjacent openings S=5.5 mm.

When the height h of the horizontal electrode plate 29 is set to be 0 mm so as to make the astigmatism amount 0 V, it is possible to achieve a large effective horizontal diameter of the main lens of ϕ9.6 mm. Furthermore, when the height h of the electrode plate 29 is set to be 5.0 mm so as to make the astigmatism amount 1700 V, it is possible to achieve a still larger effective horizontal diameter of the main lens of ϕ10.6 mm.

In the above embodiment, the three openings of the shielding cup 25 all had a circular shape. However, as shown in FIGS. 6, 7, 8 and 9, the central opening 31*b* or the openings on both sides 31*a* and 31*c* of the shielding cup 25 may be formed to have a non-circular shape, thereby adjusting the astigmatism amount provided in the three electron beams individually. In addition, there also is an advantage that, since the astigmatism amount is adjusted by the shape of the openings, a variation of the astigmatism can be restricted by a punching accuracy of the openings alone, so that the variation can be reduced.

The openings to be formed at the bottom of the shielding cup 25 also can be formed into one opening rather than three openings corresponding to the three electron beams as in the above embodiment.

Figure 10:
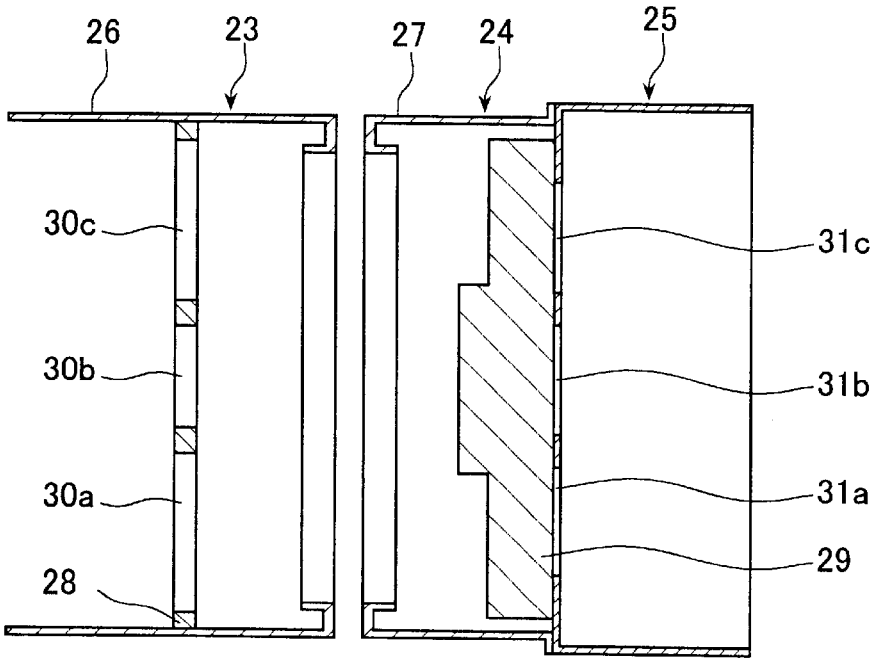
FIG. 10 illustrates another embodiment of the horizontal electrode plate of the present invention.
Figure 11:
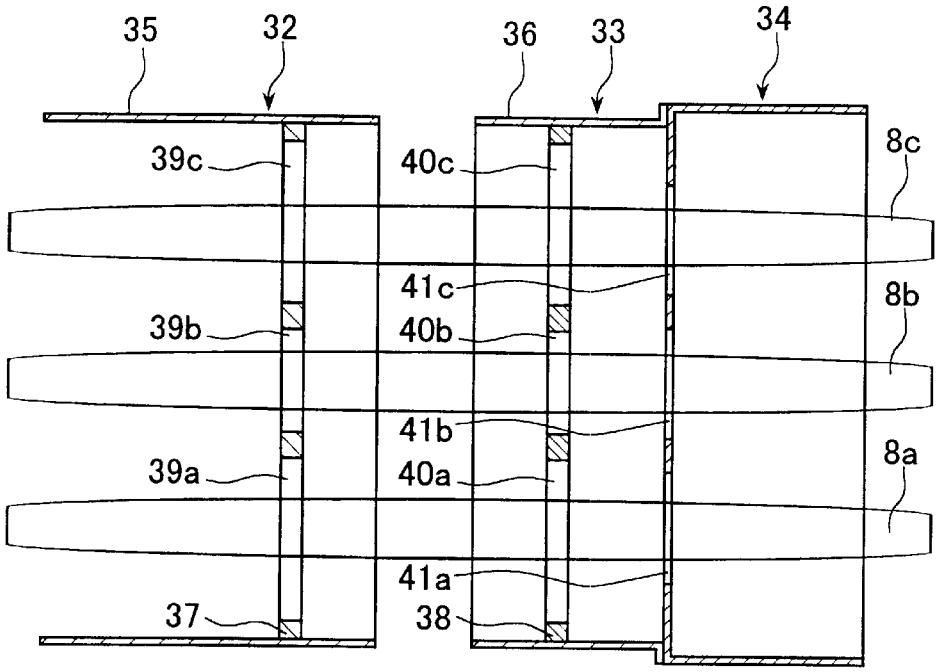
FIG. 11 (PRIOR ART)
FIG. 11 is a sectional view in the horizontal direction showing a main lens portion of a conventional electron gun.
Figure 12:
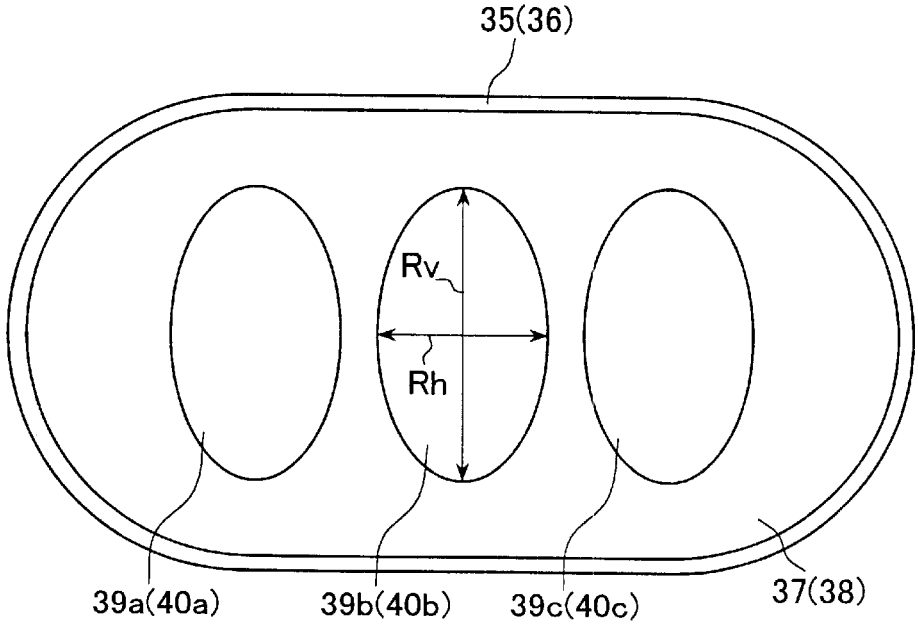
FIG. 12 (PRIOR ART)
FIG. 12 is a front view showing conventional vertical electrode plates of a focusing electrode and a final accelerating electrode.

Also, as shown in FIG. 10, the height of the horizontal electrode plate 29 in a central portion may be different from that in both edge portions, thereby adjusting the astigmatism amount provided in the three electron beams individually.

Although the pair of the horizontal electrode plates 29 were formed so as to interpose the openings of the shielding cup 25 in the vertical direction, the horizontal electrode plate 29 can be provided only above or below the openings. However, in order to obtain an image display symmetrical in the vertical direction in the screen, it is preferable that a pair of them are provided in the vertical direction.

In addition, although the final accelerating electrode 24 and the shielding cup 25 were different members in the above description, they also may be formed as one piece.

The invention described above can be applied to a color display tube using an electron gun that includes a main lens.

As described above, in accordance with the present invention, by increasing the effective diameter of the main lens so as to reduce a spherical aberration, the spot diameter on the phosphor screen can be reduced. Also, the astigmatism amount of the main lens easily can be adjusted. Therefore, the negative astigmatism of the main lens caused by the shape of the peripheral electrodes can be eliminated with a relatively simple structure. Furthermore, it is easy to provide the main lens with a given amount of positive astigmatism. As a result, it is possible not only to adjust the distortion of the spot shape due to the self-convergence magnetic field of the deflecting device but to further reduce the spot diameter in the horizontal direction. Accordingly, the focusing characteristics of the color display tube can be improved considerably, allowing an image display with a high resolution.

Moreover, in the present invention, since there is no vertical electrode plate inside the final accelerating electrode, the positions of the final accelerating electrode and the focusing electrode can be restricted only with their peripheral electrodes using a jig having the same diameter and the same axis as the final accelerating electrode and the focusing electrode, when assembling the electron gun. This eliminates the need to restrict the vertical electrode plate with a jig, thus solving a conventional problem that the deformation of the vertical electrode plate due to the jig causes a considerable deterioration of the focusing characteristics. Accordingly, the assembling accuracy of the electron gun can be improved.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A color display tube comprising:

an envelope comprising a front panel on which a phosphor screen is formed, and a funnel; and an in-line electron gun that is provided in a neck portion of the funnel and emits three electron beams; the in-line electron gun having a focusing electrode and a final accelerating electrode that are disposed facing each other in a tube axis direction so as to have a predetermined space there between and constitute a main lens, and a shielding cup that has a bottom provided with at least one opening through which the electron beams pass and is connected to a phosphor screen side of the final accelerating electrode, wherein a vertical electrode plate having three openings formed in-line through which the three electron beams pass respectively is provided inside the focusing electrode and not inside the final accelerating electrode, and a horizontal electrode plate that is substantially parallel to an in-line plane is formed at the bottom of the shielding cup so as to extend toward the focusing electrode at least one of above and below the opening provided at the bottom of the shielding cup, the horizontal electrode plate being inside the final accelerating electrode and not inside the focusing electrode.

2. The color display tube according to claim 1, wherein the number of the openings formed at the bottom of the shielding cup is three, and the three openings all have a circular shape.

3. The color display tube according to claim 1, wherein at least one of the openings provided at the bottom of the shielding cup has a non-circular shape.

4. The color display tube according to claim 1, wherein a central opening of the three openings provided in the vertical electrode plate has a diameter in an in-line direction smaller than that in a direction perpendicular to the in-line direction.

5. The color display tube according to claim 1, wherein a height of the horizontal electrode plate in the vicinity of a central beam of the three electron beams is different from that in the vicinity of beams on both sides.

* * * * *